US005441158A

United States Patent [19]

Skinner

[11] Patent Number: 5,441,158

[45] Date of Patent: Aug. 15, 1995

[54] FEEDING SYSTEM FOR A GARMENT SORTER

[75] Inventor: Karl R. Skinner, Fort Worth, Tex.

[73] Assignee: Star Uniform Rental Company, Inc., Fort Worth, Tex.

[21] Appl. No.: 168,649

[22] Filed: Dec. 16, 1993

Related U.S. Application Data

[63] Continuation-in-part of Ser. No. 837,361, Feb. 14, 1992, Pat. No. 5,301,809.

[51] Int. Cl.[6] ..... B07C 5/00

[52] U.S. Cl. ..... 209/583; 209/657; 209/937; 198/370; 198/678.1; 198/370.03

[58] Field of Search ..... 209/3.1, 3.3, 583, 656, 209/657, 937; 198/358, 370, 372, 678.1, 680

[56] References Cited

U.S. PATENT DOCUMENTS

| | | | |
|---|---|---|---|
| 1,217,986 | 3/1917 | Parce | 209/937 X |
| 2,998,136 | 8/1961 | Gerisch | 209/937 X |
| 3,124,236 | 3/1964 | Gerisch | 198/360 |
| 3,194,383 | 7/1965 | Kuwertz | 198/680 X |
| 3,451,350 | 6/1969 | Bryson | 104/88 |
| 3,612,250 | 10/1971 | Thompson et al. | 209/3.3 |
| 4,036,365 | 7/1977 | Rosenfeld | 209/937 |
| 4,239,435 | 12/1980 | Weiss et al. | 209/937 X |
| 4,909,373 | 3/1990 | Geerts | 198/465.4 X |
| 4,991,719 | 2/1991 | Butcher et al. | 209/937 X |
| 5,046,844 | 9/1991 | Milton | 198/680 X |
| 5,072,822 | 12/1991 | Smith | 209/3.3 X |
| 5,103,737 | 4/1992 | Iwase | 198/360 X |
| 5,125,513 | 6/1992 | Branch | 209/583 X |

FOREIGN PATENT DOCUMENTS

| | | | |
|---|---|---|---|
| 6009026 | 1/1994 | Japan | 198/680 |
| 625977 | 9/1978 | U.S.S.R. | 198/465.4 |

*Primary Examiner*—H. Grant Skaggs
*Assistant Examiner*—Carol L. Druzbick
*Attorney, Agent, or Firm*—Grady K. Bergen

[57] ABSTRACT

A feeding system for a sorting conveyor is provided which includes a feeder having a tubular support member upon which a plurality of unordered hangers is supported. The tubular support member is inclined and is joined to an inclined slide rail which allows the hangers to slide downward along the tubular support and inclined slide rail to a collection station. The feeder has a retractable first stop member which prevents the downward movement of the plurality of unordered hangers from moving downward along the tubular support member. While the plurality of unordered hangers is prevented from downward movement by the first stop member, a separating member is interposed between a forward hanger of the plurality of hangers. The separating member prevents downward movement of the remaining plurality of unordered hangers after the first stop member releases the forward hanger so that the forward hanger can slide along the inclined slide rail to the sorting conveyor. A reader is also provided with the feeding system which is movable between a retracted position and a reading position. The reader receives an identifying signal produced by a transponder provided with each hanger and transmits the identifying signal to a computer which tracks each hanger as it is moved along the conveyor.

24 Claims, 7 Drawing Sheets

FEEDING SYSTEM FOR A GARMENT SORTER

This application is a continuation-in-part of application No. 07/837,361, filed Feb. 14, 1992, now U.S. Pat. No. 5,301,809.

BACKGROUND OF THE INVENTION

1. Field of the Invention

This invention relates to a feeding system for a conveyor used to sort articles suspended on hangers.

2. Description of the Prior Art

Commercial laundering facilities which handle numerous garments or articles of clothing must be able to sort a large number of the articles once they have been cleaned and are ready to be delivered to the customer. Typically, commercial facilities are required to sort the articles of clothing by delivery route, customer and man. Sorting conveyors used for sorting these garments must be able to sort a large number of garments quickly without requiring a great deal of man power. Conveyors used for sorting these various articles usually consist of a conveyor which has attachment members upon which the garments supported on clothes hangers are placed. Once the articles are placed on these attachment members, the conveyor carries the garments to various sorting stations along the path of the conveyor. Automated means for removing the articles from the conveyor are provided at each station so that the garments, which are identified with a particular route, customer or man, are collected at each station. The conveyor usually moves continuously with the garments being placed on the attachment members one at a time, each attachment member supporting one garment. In order to supply the conveyor with the garments to be sorted, an operator is usually required to feed each individual garment onto the attachment members of the conveyor. In most cases, an operator is also required to scan or input identification data for each garment into a computer. This allows each article to be tracked by the computer as the article is moved along the conveyor so the computer can control the automated means for removing the articles when the article passes the appropriate sorting station.

Due to the large volume of garments or articles that are required to be sorted, the task of feeding and identifying the articles becomes quite repetitious. A human operator is often slow or inefficient in feeding the articles to the sorting conveyor. What is needed is an automated feeding system wherein a large number of articles can be separated and fed to the conveyor and be automatically identified.

SUMMARY OF THE INVENTION

A feeding system is provided for feeding individual articles supported on hangers from a plurality of articles which are supported on a plurality of unordered hangers to a sorting conveyor. The sorting conveyor has a plurality of attachment members which are spaced along the length of the conveyor for conveying the individual articles to various sorting stations. The conveyor and attachment members are driven along a conveyor path to a collection station, where the articles are received from the feeding system.

The feeding system includes an elevated support member which has a forward end and a rearward end. The support member supports the plurality of unordered hangers and is inclined so that the plurality of hangers is caused to move downward along the support member to the collection station from the rearward end to the forward end. A first stop member, mounted adjacent to the support member, is movable between an engaged position and a disengaged position. By moving the first stop member to the engaged position, the first stop member engages a forward hanger of the plurality of hangers so that the plurality of hangers is prevented from downward movement along the support member. A separating member, which is also mounted adjacent to the support member, is provided and is movable between a withdrawn position and an interposed position. When the separating member is in the interposed position, the separating member engages the plurality of hangers so that a forward hanger is separated from the plurality of hangers of unordered hangers and prevents the remaining plurality of hangers from moving downward along the support member when the first stop member is moved to the disengaged position. When the first stop member is moved to the disengaged position, the forward hanger is allowed to move downward along the support member.

A second stop member, which is movable between a load and unload position, is also mounted adjacent to the support member. The second stop member engages the forward hanger when in the load position after the forward hanger is disengaged from the first stop member so that the forward hanger is prevented from further downward movement along the support member.

A collection stop member or gate, which is movable between a retaining position and a feed position, is mounted adjacent to the support member as well. The collection stop member prevents the downward movement of the forward hanger along the support member when in the retaining position when the second stop member disengages the forward hanger.

When the forward hanger is engaged by the collection stop member, a reader moves to a reading position from a retracted position. The reader, when in the reading position, is located in sufficient proximity to the forward hanger to read and identify the forward hanger or article which is to be fed to the sorting conveyor. Computer means is provided to receive an identifying signal from the reader.

After the forward hanger has been identified, the collection stop member is moved to the feed position thus disengaging the forward hanger. The forward hanger moves downward along the support member to one of the attachment members at the collection station. The computer correlates each individual article with an attachment member and calculates the position of each attachment member as the conveyor is driven along the conveyor path to the various sorting stations.

DETAILED DESCRIPTION OF THE INVENTION

Figure 1:
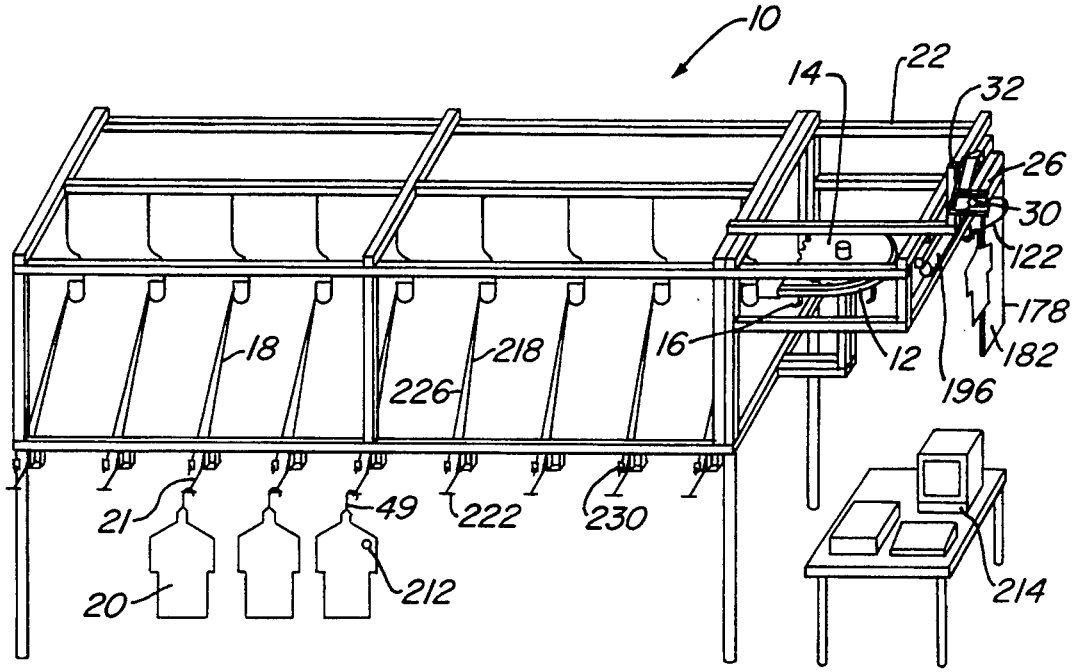
FIG. 1 is a perspective view of a sorting conveyor with the feeder system constructed in accordance with the invention.
Figure 8:
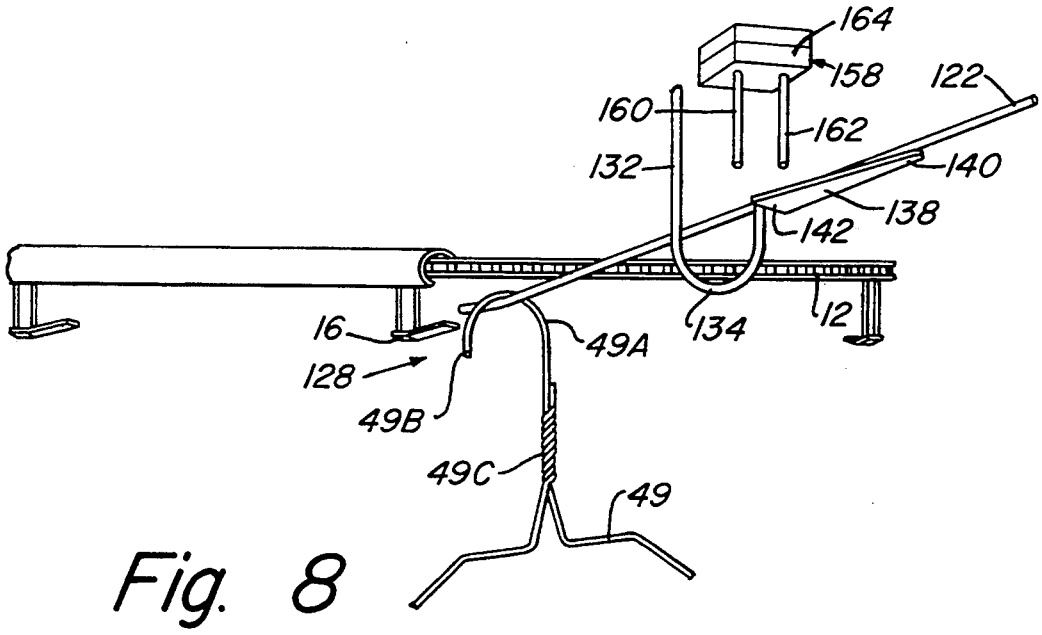
FIG. 8 is a perspective view of a slide rail and attachment members of the conveyor constructed in accordance with the invention.

Referring to the figures, FIG. 1 shows a sorting conveyor 10 having a flexible linkage 12 which is driven by drive means 14, such as a motor driven wheel or sprocket. Spaced along the flexible linkage 12 are a series of attachment members 16 which are spaced at regular intervals along the length of the flexible linkage 12. The flexible linkage 12 moves along a conveyor path wherein the attachment members are moved along the conveyor path to various sorting stations 18. Garments 20 supported on hangers are moved from the attachment members 16 and are collected at receiving stations 21. The sorting conveyor 10 is constructed with a steel frame structure 22 for supporting and housing components of the conveyor 10. A more detailed description of a sorting conveyor of this type is described in the U.S. patent application identified by Ser. No. 07/837,361, filed Feb. 14, 1992 and entitled "Sorting Conveyor" and is herein incorporated by reference.

Figure 3:
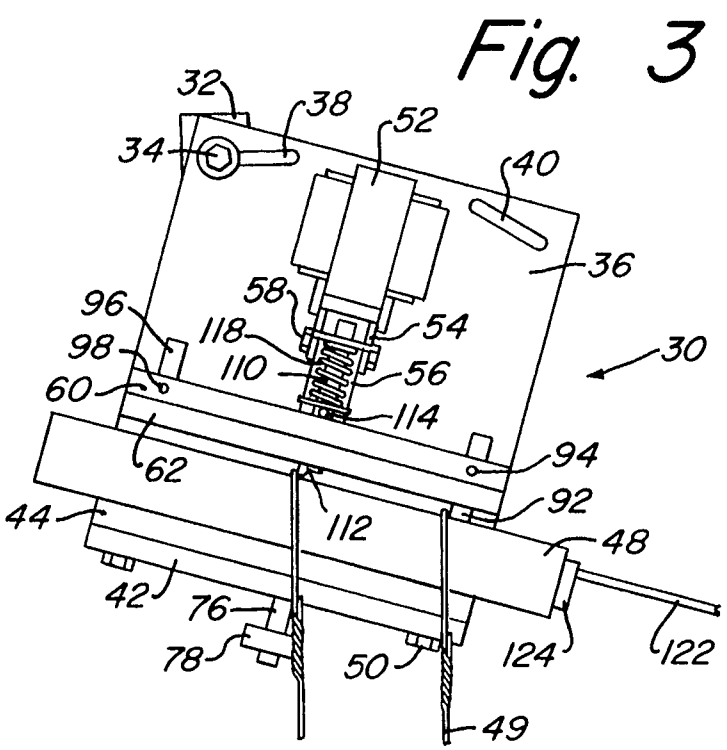
FIG. 3 is a side view of a feeder of the feeding system constructed in accordance with the invention.
Figure 2:
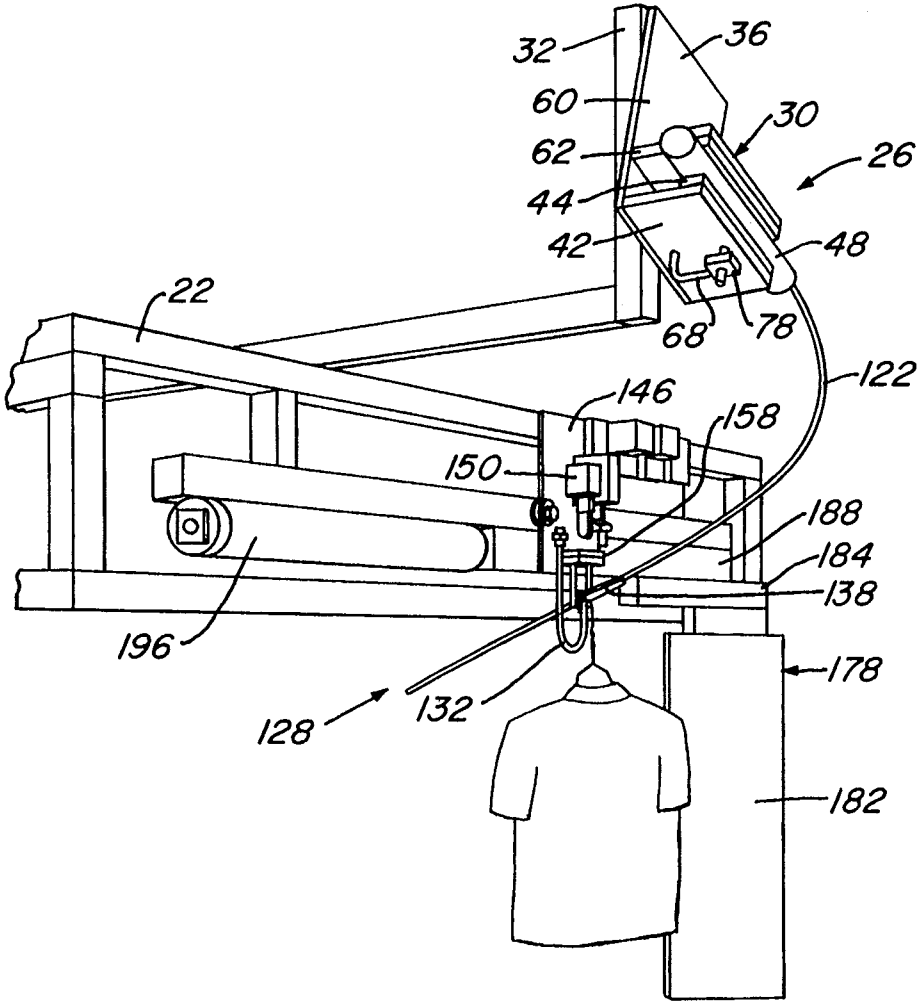
FIG. 2 is a perspective view of the feeding system as constructed in accordance with the invention.

FIG. 2 shows a feed system 26 of the invention which is mounted to one end of the frame 22 of the sorting conveyor 10. The feed system 26 consists of an elevated feeder 30, which is mounted to a vertical arm 32 of the frame 22. As shown in FIG. 3, the feeder 30 is attached to the vertical arm 32 by bolt 34. The feeder 30 consists of a flat, rectangular shaped back plate 36 made of steel and oriented in a vertical plane. The back plate 36 has elongated slots 38, 40. As seen in FIG. 3, the elongated slots 38, 40 are set at slight angles to the edges of the plate 36. This allows the feeder 30 to be adjustably positioned at various angles when the bolt 34 is loosened.

Rigidly joined to the lower end of the back plate 36 is a lower support plate 42. The lower support plate 42 extends perpendicularly from the surface of the back plate 36 and parallel to the lower edge of the back plate 36. Adjustably mounted to the upper surface of the free end of the lower support plate 42 is a support platform 44. The support platform 44 is an elongated rectangular block to which a tubular support member 48 is welded or otherwise rigidly joined to the upper surface of the support platform 44.

Figure 4:
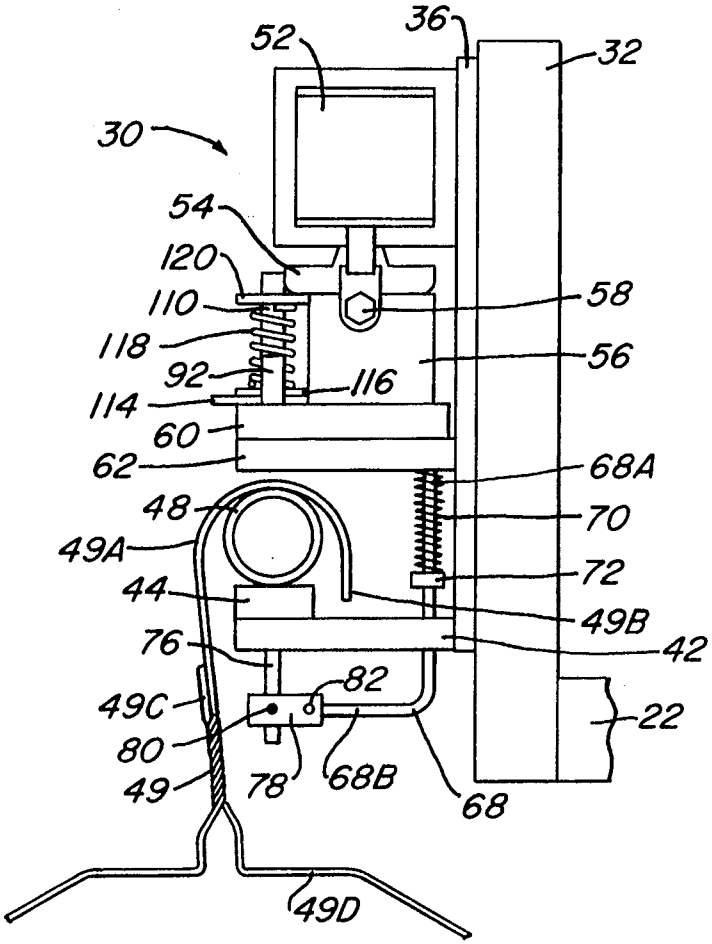
FIG. 4 is a front side view of the feeder constructed in accordance with the invention.

FIG. 4 shows the front or forward end of the tubular support member 48. The tubular support member 48 has a circular cross section and has an outer diameter which allows hangers 49, such as those commonly used for the hanging of garments or clothing, to be easily supported thereon. The support platform 44 has a width no greater than the diameter of the tubular support member 48.

As can be seen in FIG. 4, the upper portion of the hook 49A of the hanger 49 rests on the upper surface of the tubular support member 49 with the free end 49B of the hook 49A overhanging the tubular support 48. The support platform 44 is of such height to elevate the tubular support member 48 above the upper surface of the lower support plate 42 so that the free end 49B of the hook 49A is suspended between the back plate 36 and the tubular support 48 and is clear of any obstruction when moved to any position along the length of the tubular support member 48.

With the hook portion 49A of the hanger 49 seated on the tubular support member 48, the neck portion 49C and shoulder portions 49D of the hanger 49 should clear the lower support plate 42 and other components of the feeder 30 as the hanger 49 is moved to any position along the entire length of the support member 48.

The support platform 44 and tubular support member 48 are mounted to the lower support plate 42 by means of fasteners 50, such as bolts and nuts. The lower support plate 42 is provided with elongated slots (not shown) through which the bolts 50 extend. The elongated slots allow the tubular support member 48, which is mounted to the support platform 44, to be adjusted or otherwise variably positioned on the lower support plate 42.

As can be seen in FIG. 3, the tubular support member 48 is substantially straight and is inclined downward from the rearward end to the forward end. By adjusting the position of the back plate 36 relative to the vertical arm 32 by means of the elongated slots 38, 40, the tubular support member 48 can be inclined at various angles. The tubular support member 48, as shown in FIG. 3, is inclined at approximately 105 degrees to the vertical arm 32. This causes the hangers 49 which are supported on the tubular support member 48 to slide downward from the rearward end to the forward end of the tubular support member 48.

Mounted above the tubular support member 48 on the back plate 36 is an electrical solenoid 52. The solenoid 52 is provided with a pull arm 54, which extends from the lower end of the solenoid 52. When the solenoid 52 is actuated, the pull arm 54 is caused to move upward or away from lower support plate 42 and tubular support member 48. A steel block member 56 is mounted to the pull arm 54 by means of bolts 58 which extend through the block member 56. The block member 56 is rectangular in shape and oriented in a plane perpendicular to the lower support plate 42 and back plate 36. A base plate 60 is joined to the lower end of the block member 56. The base plate 60 is substantially flat and is oriented so that it is parallel to the lower support plate 42.

An upper contact plate 62 is rigidly joined along one edge to the back plate 36 directly below the base plate 60. The contact plate 62 is parallel to the base plate 60 with the lower surface of the contact plate 62 being spaced apart a distance from the upper surface of the tubular support member 48 to allow the upper portion of the hook 49A to pass therebetween.

An L-shaped arm 68 is provided having an upper portion 68A and a lower portion 68B. The upper portion 68A of the L-shaped arm 68 extends parallel to the back plate 36 through concentric holes or slots (not shown) formed in the support plate 42 and the upper contact plate 62. The upper end of the upper portion 68A of the L-shaped arm 68 is mounted to and extends from the lower surface of the base plate 60. The upper portion 68A should be able to slide freely through the holes in the lower support plate 42 and upper contact plate 62. When the solenoid 52 is deactivated, the lower surface of the base plate 60 is forced downward contacting the upper surface of the upper contact plate 62 and forcing the L-shaped arm 68 downward. An outwardly biased spring 70 circumferentially surrounds and extends along the upper portion 68A of the L-shaped arm 68 and is located between a retaining nut 72 and the lower surface of the upper contact plate 62. The outwardly biased spring 70 aids in forcing the L-shaped arm 68 downward.

Figure 5:
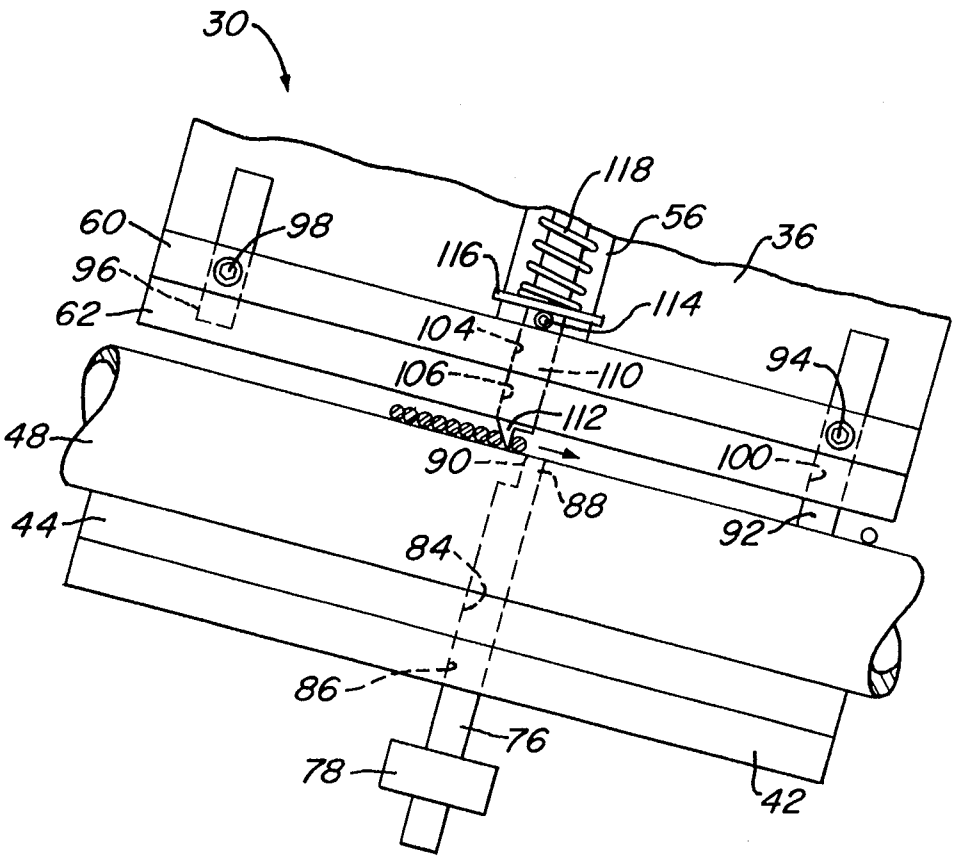
FIG. 5 is an enlarged view of the feeder showing a separating member in an interposed position and constructed in accordance with the invention.

A first stop member 76 is mounted to the end of the lower portion 68B of the L-shaped arm 68 by means of a mounting block 78. The lower portion 68B of the L-shaped arm 68 is substantially perpendicular to the back plate 36 with the mounting block 78 joined to the end of the lower portion 68B of the L-shaped arm 68 by means of a fastener or set screw 82. The lower end of the first stop member 76 is also mounted in the block 78 and fastened thereto by means of fastener or set screw 80. The first stop member 76 consists of a cylindrical steel rod which extends upward through a bore 84 formed by concentric holes in the support platform 44 and tubular support member 48, and a slot 86 provided in the lower support plate 42, as shown in FIG. 5. At the upper end of the first stop member 76 is a seat 88 formed by removing a half cylindrical portion of the upper end of the stop member 76 to provide a contact surface 90.

A second stop member 92 extends through and is adjustably mounted to the base plate 60 and is retained in place by means of a fastener 94 or set screw. The second stop member 92 extends through the upper contact plate 62 through a bore hole 100 directly over the upper surface of the tubular support member 48. An additional stop member 96, which is identical to the stop member 92, may be provided at the opposite end of the base plate 60. The stop member 96 is mounted to the base plate 60 by means of a set screw 98. The additional stop member 96 is kept in a raised position when not in use as shown in FIG. 5. The additional stop member 96 is provided so that the tubular support member 48 can be inclined in the opposite direction if necessary.

Located in the base plate 60 and upper contact plate 62 directly over the upper surface of the tubular member 48, are two concentric bore holes 104, 106 formed in the base plate 60 and upper contact plate 62, respectively. As shown in FIG. 5, a separating member 110 extends through the bore holes 104,106 when the base plate 60 is in contact with the upper contact plate 62. The separating member 110 consists of a steel rod having a wedge-shaped tip 112 located at its lower end. The separating member 110 is spring mounted to the base plate 60. This is accomplished by providing a roll pin or retaining pin 114 which extends perpendicularly through the separating member 110. The roll pin 114 contacts the upper surface of the base plate 60 and prevents downward movement of the separating member 110 through the bore hole 104 of the base plate 60. A lower washer 116 is seated above the roll pin 114 around the separating member 110. Seated against the upper surface of the lower washer 116 is a coiled spring 118 which circumferentially surrounds the separating member 110. The coiled spring 118 is retained in place by an upper washer 120 which engages the pull arm 54 of the solenoid 52. Thus, when the pull arm 54 of the solenoid 52 is retracted and caused to move upward, the base plate 60 is also caused to move upward so that the upper surface of the base plate 60 bears against the roll pin 114 and raises the separating member 110.

When the solenoid 52 is deactivated, the pull arm 54, block member 56 and the base plate 60 are forced downward against the upper contact plate 62. This causes the separating member 110 to be forced to an interposed position toward the upper surface of the tubular support member 48 so that the wedge-shaped tip 112 is in a near touching relationship with the upper surface of the tubular support member 48. The second stop member 92 is also forced to a load position wherein the lower end of the second stop member 92 abuts against the upper surface of the tubular member 48.

Because the separating member 110 is spring mounted to the base plate 60, if an object, such as a hanger, becomes wedged or trapped between the separating member 110 and the upper surface of the tubular member 48 as the base plate 60 is forced against the upper contact plate 62, the separating member 110 will be lifted upward compressing the spring 118. This prevents the feeder 30 from jamming and helps prevent damage to the hangers which are fed through the feeder 30.

Figure 6:
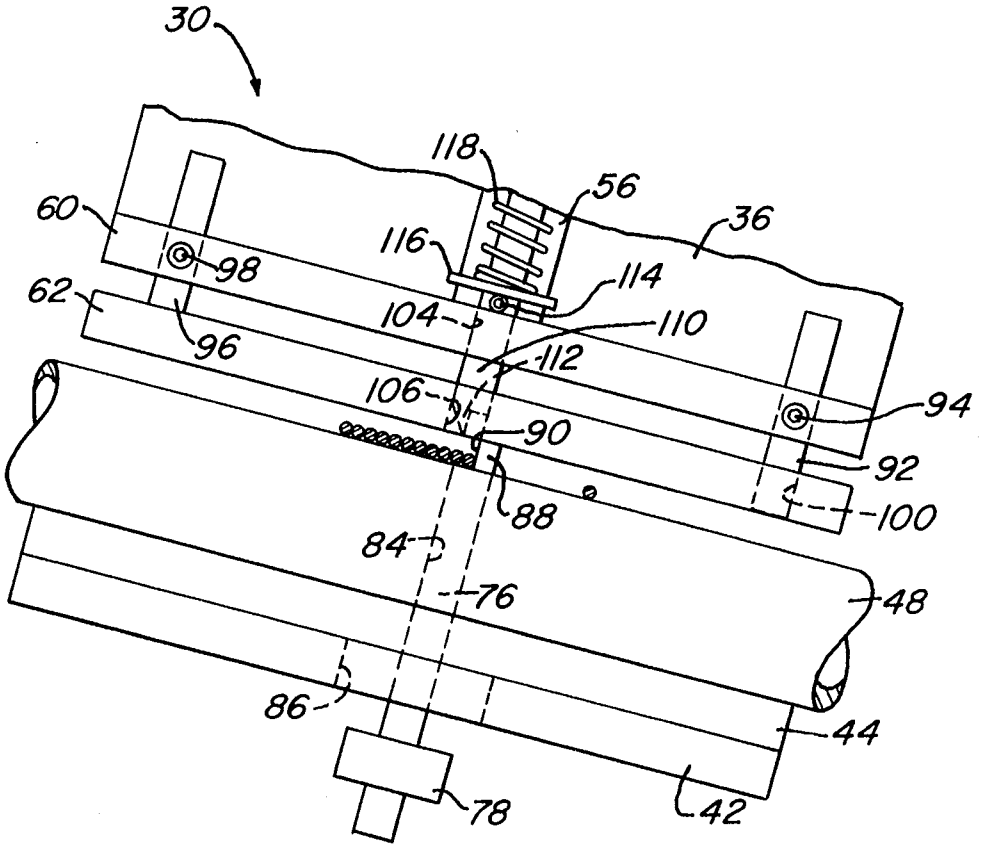
FIG. 6 is the feeder of FIG. 5 showing the separating member in a withdrawn position.

Referring to FIGS. 5 and 6, the longitudinal axis of the separating member 110 is parallel to the longitudinal axis of the first stop member 76. The separating member 110 should be offset slightly to the rear of the first stop member 76 along the tubular support member 48 so that the wedge-shaped tip 112 is laterally spaced apart from the contact surface 90 of the tip 88 a distance approximately equal to the thickness of the hook portion 49A of the hanger 49. The second stop member 92 should be located approximately three to six inches from the first stop member 76 and the separating member 110.

As shown in FIGS. 2 and 3, an inclined slide rail 122 is joined to the forward end of the tubular support member 48. The inclined slide rail 122 is rigidly mounted to a plug 124 which is inserted into the forward end of the tubular support member 48. The inclined slide rail 122 may be a steel rod which is curved so that hangers sliding down the tubular support member 48 can be directed in areas which are not parallel to the longitudinal axis of the support member 48. The inclined slide rail 122 and tubular support 48 define a feed path along which the hangers slide to a collection station 128. The slide rail 122 is supported by the plug 124 mounted within the tubular support 48 and by a support member 132 located near a free end of the inclined slide rail 122 at the collection station 128. The support 132 has a curved portion 134 which curves from under the inclined slide rail and laterally away to allow the free end 49B of the hanger 49 to pass thereby.

A wedge-shaped guide 138 is joined to the lower surface of the inclined slide rail 122. The wedge-shaped guide 138 increases in width downward along the inclined slide rail 122 from a narrow end 140 to a wide end 142. The wedge-shaped guide 138 causes the hooked portion 49A to slide along the inclined slide rail 122 substantially perpendicular to the axis of the slide rail 122 prior to being fed to the attachment members 16. This also prevents the hanger 49 from twisting along the slide rail 122 which can slow the progress of the hanger 49 as it slides along the rail 122.

Figure 7:
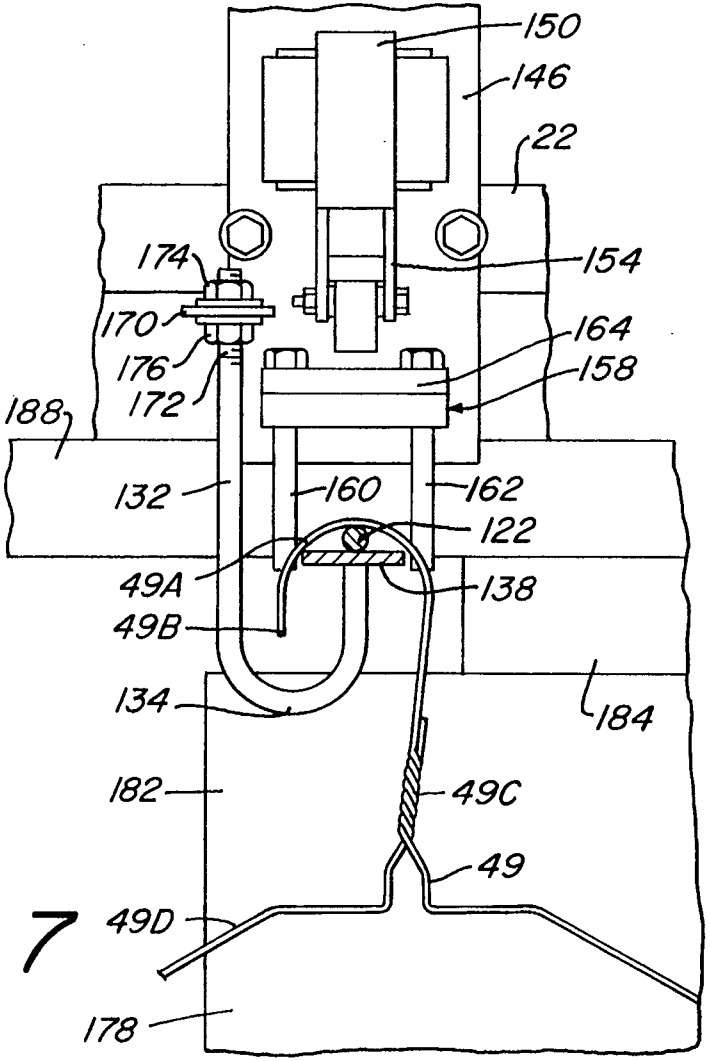
FIG. 7 is a side view of a collection stop constructed in accordance with the invention.

Referring to FIG. 7, located above the slide rail 122 and mounted to the frame 22 of the conveyor 10 is a plate 146. Attached to the plate 146 is a solenoid 150 which can be actuated to pull a solenoid arm 154 upward. A collection stop member or gate 158 is attached to the solenoid arm 154 and consists of two parallel rods 160, 162 which are mounted in a base 164 so that the rods 160, 162 project along either side of the inclined slide rail 122 adjacent to the wide end 142 of the wedge-shaped guide 138. As can be seen in FIG. 7, the rods 160, 162 are spaced apart on either side of the inclined slide rail 122 so that the hooked portion 49A of the hanger 49 abuts against the ends of the rods 160, 162, thereby preventing downward movement of the hanger 49 along the inclined slide rail 122.

The collection stop member or gate 158 prevents the hangers 49 from moving to the collection station 128 where the hangers 49 are received on the attachment members 16. The gate 158 is normally in the retaining position as shown in FIG. 7. When the solenoid 150 is actuated, the gate 158 is raised to a feed position, whereby a hanger 49 is allowed to slide along the slide rail 122 to the collection station 128.

The support 132 is mounted to the plate 146 by means of a flat projection 170 which protrudes from the plate 146. The flat projection 170 has a hole through which a threaded end 172 of the support 132 extends. Upper and lower nuts 174, 176 on the threaded portion 172 retain the support 132 in place. By adjusting the position of the upper and lower nuts 174, 176, the inclined slide rail 122 can be positioned so that the rods 160, 162 of the gate 158 engage the hanger 49. It should also be noted that the rods 160, 162 can also be lengthened or shortened for the proper engagement with the hanger 49.

Figure 9:
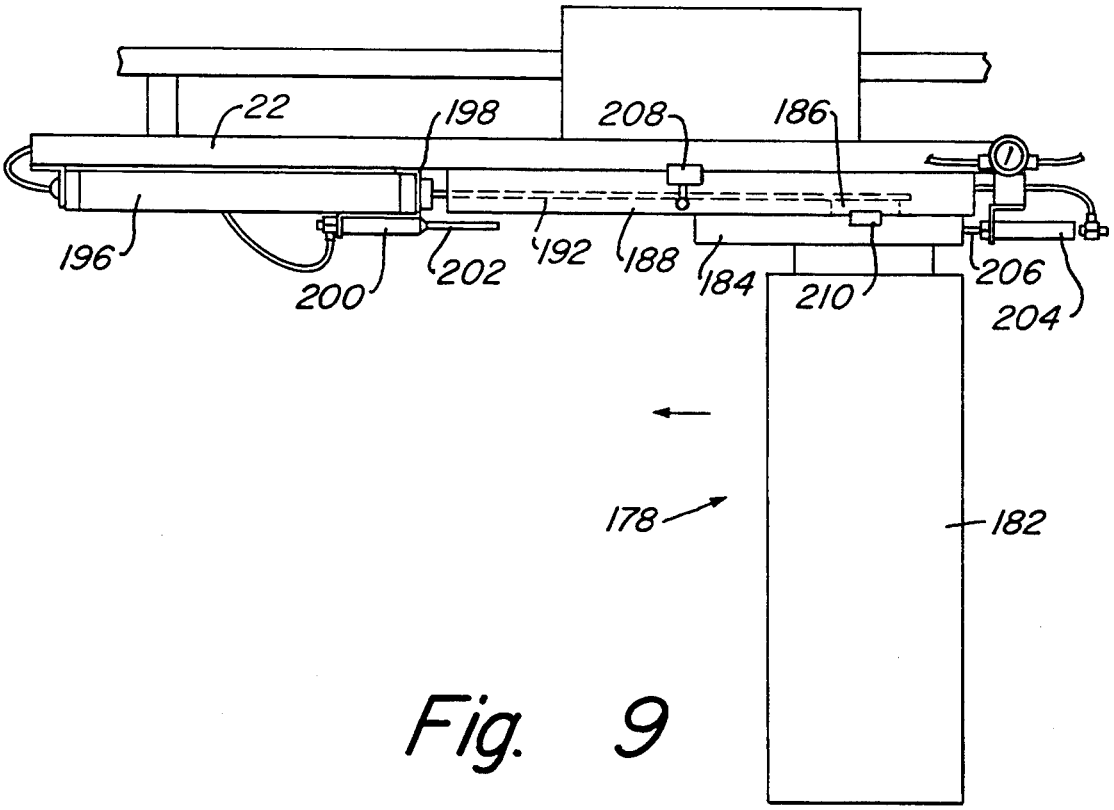
FIG. 9 is a front side view of a reader constructed in accordance with the invention.

Referring to FIG. 7, a reader 178 is provided to read identifying information supplied with each hanger 49 so that the articles can be identified and the information can be stored in a computer. The reader 178 consists of an antenna 182 which is mounted at its upper end to a horizontal arm 184. The horizontal arm 184 extends laterally away from the antenna 182 to provide clearance over the slide rail 122 when the reader 178 is moved to a reading position. This can best be seen in FIG. 9.

The horizontal arm 184 is mounted to an extension or rider 186 which slides along a guide rail 188. The guide rail 188 consists of a horizontal, hollow tubular member having a groove extending along its length in which the extension 186 can slide. The extension 186 is joined to one end of a rod 192, the opposite end of the rod 192 being joined to the piston of a pneumatic piston and cylinder 196 of conventional design. The piston and cylinder 196 are mounted to the frame 22 of the sorting conveyor 10 by means of brackets 198. By actuating the pneumatic piston and cylinder 196, the rod 192 can be extended and retracted, thereby moving the extended portion 186 along the guide rail 188. This in turn moves the reader 178 from the reading position to a retracted position. When the reader 178 is in the retracted position, the reader is located away from the hanger 49 engaged by the collection gate 158 so that the reader 178 does not interfere with the hanger 49 or the article supported on the hanger 49 as the hanger 49 moves along the feed path to the collection station 128.

A small air cylinder 200 having a plunger 202 is mounted to the end of the pneumatic piston and cylinder 196 from which the rod 192 extends. The plunger 202 of the air cylinder 200 absorbs the impact of the horizontal arm 184 as the antenna 182 is moved to the reading position. Mounted to the frame 22 opposite the air cylinder 200 is another small air cylinder 204 having a plunger 206 which absorbs the impact of the horizontal arm 184 as the antenna 182 is moved to the retracted position.

Mounted to the frame 22 above the horizontal arm 184 is a limit switch 208. The limit switch 208 is triggered by a contact plate 210 mounted on the horizontal arm 184. As the reader 178 is moved to the reading position, the limit switch 208 is triggered by the contact plate 210. This activates the antenna 182 so that a radio signal at a given frequency is transmitted by the antenna 182 to a transponder 212 (FIG. 1) provided with each hanger 49. The transponder 212 is usually attached to the garment or article. The radio signal from the antenna 182 charges the transponder 212 so that the transponder 212 produces and transmits an identifying signal back to the antenna 182. The reader 178 then transmits the identification signal from the transponder 212 to a computer 214, as shown in FIG. 1, which in turn stores the identifying information.

Figure 10:
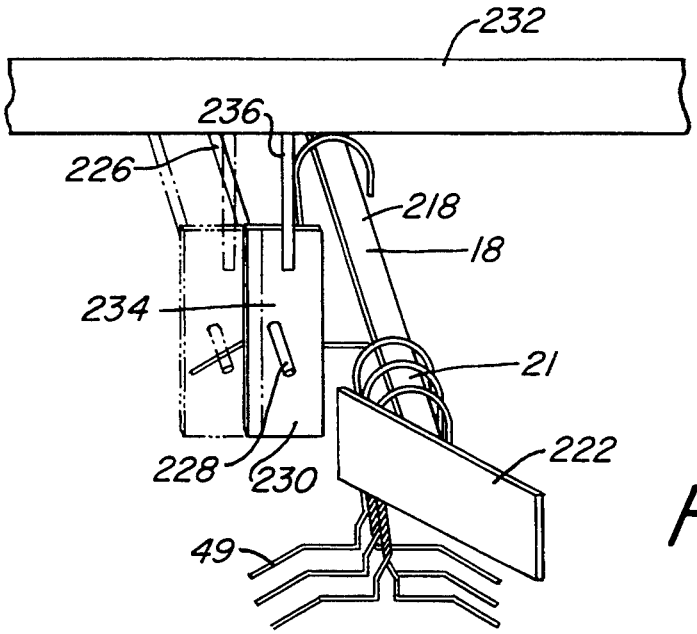
FIG. 10 is a side view of a receiving station of the sorting conveyor constructed in accordance with the invention.
Figure 11:
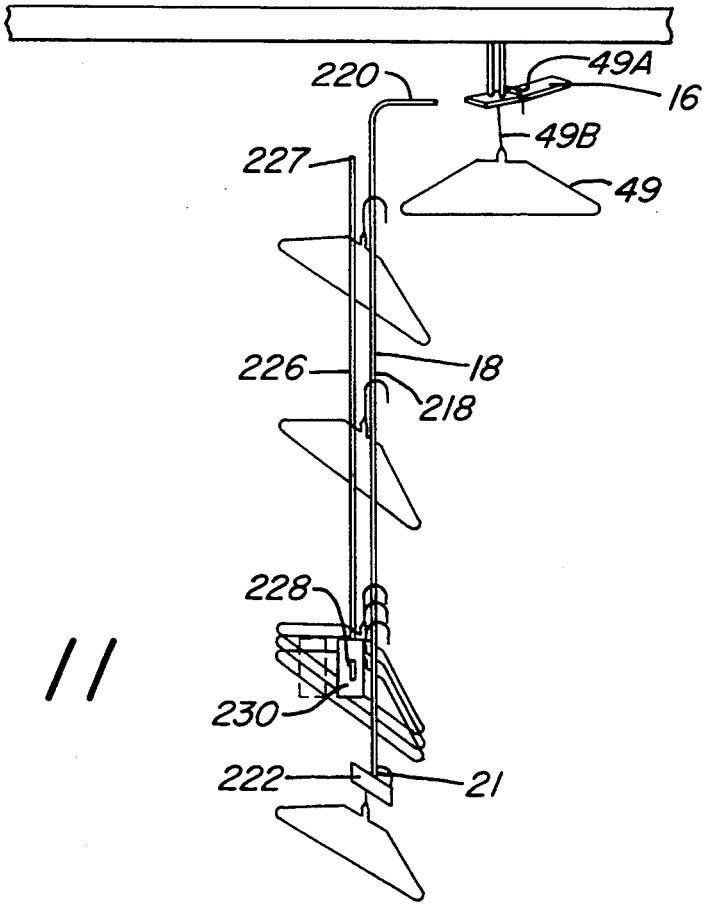
FIG. 11 is a side view of a sorting station of the sorting conveyor constructed in accordance with the invention.

Referring now to FIGS. 10 and 11, the sorting station 18 and receiving station 21 are shown in further detail. The sorting station 18 has an inclined pick-off rail 218 with an engaging probe 220 (FIG. 10) at one end which is located adjacent to the conveyor path of the sorting conveyor 10. Mounted to the end of the pick-off rail 218 opposite the engaging probe 220 is a stop plate 222. The pick-off rail 218 slopes downward from the engaging probe 220 to the stop plate 222 so that hangers 49 tend to slide downward along the pick-off rail 218 to the stop plate 222. The pick-off rail 218 is actuated by a solenoid (not shown) which is controlled by the computer 214 so that the pick-off rail 218 is lowered to a pick-off position. The stop plate 222 and the end of the pick-off rail 218 joined thereto form the receiving station 21. The stop plate 222 has a sufficient width to prevent the hangers from sliding off the end of the pick-off rail 218.

Mounted adjacent to the pick-off rail 218 is a guide rail 226. The guide rail 226 has an upper end 227 located adjacent to the engaging probe 220 of the pick-off rail 218 and a lower end 228 which is mounted to a stop arm 230. The guide rail 226 is spaced a distance from the pick-off rail 218 to allow the curved portion 49A and neck portion 49C of a hanger to pass therebetween. The guide rail 226 should be close enough, however, to contact the curved portion 49A or neck portion 49C of each hanger that slides along the pick-off rail 218 so that each hanger is stabilized and does not twist as it slides along the pick-off rail 218 to the receiving station 21. The guide rail 226 maintains the hangers 49 in a transverse position relative to the pick-off rail 218.

The stop arm 230 is mounted to an actuator 232 adjacent to the pick-off rail 218. The stop arm 230 consists of a vertical plate 234 which is connected to the actuator 232 by means of a support 236. The lower end 228 of the guide rail 226 is mounted to the plate 234. The actuator 232 causes the stop arm 230 to move between an engaged position and a disengaged position, which is shown in outline. When in the engaged position, the stop arm 230 is positioned in the path of hangers 49 sliding downward along the pick-off rail 218 so that the hangers are prevented from reaching the receiving station 21. When in the disengaged position, the stop arm 230 is located away from the path of the hangers 49 thus allowing the hangers to pass to the receiving station 21. The actuator 232 is controlled by the computer 214 and can be any conventional mechanism, such as a solenoid or piston and cylinder arrangement, which moves the stop arm 230 between the engaged and disengaged positions.

The operation of the feeding system is as follows. Initially, the solenoid 52 of the feeder 30 is not actuated so that the base plate 60 is forced against the upper surface of the upper contact plate 62 and the separating member 110 is forced towards the upper surface of the tubular support member 48, with the wedge-shaped tip 112 almost abutting the upper surface of the tubular support member 48. With the base plate 60 forced against the upper contact plate 62, the second stop member 92 is also forced through the bore hole 100 towards the upper surface of the tubular support member 48.

Unordered hangers 49 supporting the articles which are to be fed to the conveyor 10 are positioned on the rearward end of the tubular support member 48 with the free ends 49B being located between the tubular support member 48 and the back plate 36, as shown in FIG. 4. The hooked portions 49A of the unordered hangers should not overlap or otherwise be intertwined. When the plurality of unordered hangers are so positioned on the rearward end of tubular support member 48, the plurality of unordered hangers 49 will tend to slide towards the forward end of the support member 48. The unordered hangers are prevented from downward movement along the support member 48, however, by the wedge-shaped tip 112 of the separating member 110, the hooked portion 49A of the forward hanger of the plurality of hangers contacting the rearward side of the wedge-shaped tip 112. The hooked portion 49A of the forward hanger, in turn, prevents the downward movement of the rearward adjacent hanger, which in turn contacts its adjacent rearward hanger, and so forth, so that the plurality of unordered hangers are aligned side by side along the tubular support member 48 with each hooked portion 49A of each hanger abutting against the hooked portion 49A of an adjacent hanger.

When the solenoid 52 is actuated to begin feeding the hangers, the pull arm 54 pulls the block member 56 and base plate 60 upward. When the plate 60 is moved upward, the separating member 110 is also forced upward to a withdrawn position through the bore holes 104, 106 as the plate 60 contacts the roll pin 114. The second stop member 92 mounted to the base plate 60 is also forced upward through the bore hole 100 to the unload position. As this occurs, the L-shaped arm 68 mounted to the base plate 60 is carried upward so that the first stop member 76 is lifted to an engaged position through the slot 86 and bore hole 84, as shown in FIG. 6, with the tip 88 of the first stop member 76 protruding from the bore hole 84 above the upper surface of the tubular member 48.

When the separating member 110 is moved to the withdrawn position, in the manner described above, the plurality of hangers slides downward along the tubular member 48. The plurality of hangers 49 are prevented from moving further downward, however, by the first stop member 76 with the hooked portion 49A of the forward hanger contacting the contact surface 90 of the tip 88.

The solenoid 52 is then deactivated so that the base plate 60 is forced downward against the upper contact plate 62 and the separating member 110 and second stop member 92 are forced downward to the interposed and load positions, respectively. As the separating member 110 moves to the interposed position, the wedge-shaped tip 112 is inserted or wedged between the forward hanger and the remaining rearward plurality of unordered hangers. Simultaneously, the base plate 60 causes the L-shaped arm 68 to move the first stop member 76 downward to a disengaged position so that the tip 88 is withdrawn below the upper surface of the tubular member 48 through the bore hole 84. This causes the forward hanger to be released and slide along the upper surface of the tubular member 48, as shown by the arrow in FIG. 5. The released forward hanger is prevented from further downward movement by the second stop member 92 which is in the load position. Because the second stop member 92 is spaced at a distance along the support member 48 from the separating member 110 and the first stop member 76, the garment supported on the released forward hanger is allowed to separate from the other garments, breaking any electrostatic attractive forces between the garments.

As the released forward hanger moves downward along the tubular support member 48 to the second stop member 92, the rearward plurality of hangers is prevented from moving downward along the tubular member 48 by the wedge-shaped tip 112 of the separating member 110.

The solenoid 52 is then actuated again pulling the base plate 60 upward and raising the separating member 110 and the second stop member 92 to the withdrawn and unload positions, respectively, so that the separating member 110 and second stop member 92 are no longer in contact with the hangers. This allows the plurality of unordered hangers to slide downward along the tubular support member 48 toward the first stop member 76, and the forward hanger to move downward along the tubular support member 48 to the inclined slide rail 122. Simultaneously, the first stop member is raised to the engaged position, shown in FIG. 6, so that the remaining plurality of unordered hangers 49 rest against the first stop member 76.

When the solenoid is deactivated, the base plate 60 is forced against the contact plate 62 once again. This causes the separating member 110 to be moved to the interposed position and the first and second stop members 76, 92 to be moved to the disengaged and unload positions, respectively. When the separating member 110 is moved to the interposed position, the wedge-shaped tip 112 of the separating member 110 is inserted between the next forward hanger of the remaining plurality of unordered hangers, separating out the next forward hanger. This and each successive forward hanger is progressively fed through the feeder 30 by the continued raising and lowering of the base plate 60 as described above.

It should be noted that due to misalignment of the wedge-shaped tip 112 or variance in the sizes or thicknesses of the hangers being fed through the feeder 30, the separating member 110 may sometimes trap a hanger beneath the wedge-shaped tip 112 when moved to the interposed position. Because the separating member 110 is spring mounted to the base 60, the separating member is able to retract slightly to prevent damage to the feeder 30 or the hangers when this occurs.

When each forward hanger is released from the second stop member 92 of the feeder 30, the forward hanger is allowed to slide downward along the feed path on the inclined slide rail 122. As the hanger slides along the slide rail 122, the hooked portion 49A of the hanger contacts the wedge shaped guide 138 so that the hanger is forced into a position perpendicular to the axis of the slide rail 122. The hanger is then stopped from further downward movement along the inclined slide rail 122 by the rods 160, 162 of the collection stop member or gate 158.

While the hangers 49 are being fed through the feeder 30, the flexible linkage 12 and attachment members 16 of the conveyor 10 are driven along the conveyor path. As each attachment member 16 approaches the collection station 128, the attachment member 16 approaching the collection station 128 will activate a microswitch (not shown) which in turn actuates the pneumatic piston and cylinder 196. This causes the piston rod 192 to pull the horizontal arm 184 and the antenna 182 to the reading position where the antenna 182 is located adjacent to the garment supported on the hanger 49 engaged by the rods 160, 162.

As the horizontal arm 184 is moved to the reading position, the end of the horizontal arm 184 contacts the plunger 202 of the cylinder 200 which acts as a shock absorber. As the horizontal arm 184 contacts the plunger 202, the contact plate 210 triggers the limit switch 208. The limit switch 208 reverses the air to the piston and cylinder 196 so that the rod 192 is extended and the reader 178 is moved to the retracted position. At the same time, the limit switch 208 also causes the antenna 182 to be activated so that a radio signal is transmitted from the antenna 182 at a frequency which charges the transponder 212 attached to the garment supported on the hanger which is engaged by the rods 160, 162 of the collection stop member 158. In response to the radio signal from the antenna 182, the transponder 206 is energized to produce the identifying signal which is transmitted back to the antenna 182 of the reader 178. This occurs almost instantly. It should be noted that each garment supported on each of the hangers 49 is provided with a transponder 206 which produces a different identifying signal. The reader 178 then transmits the identifying signal to the computer 214, where it is stored. When the reader 178 moves to the retracted position, the horizontal arm 184 contacts the plunger 206 of the air cylinder 204 which also acts as a shock absorber.

As each attachment member 16 approaches the collection station 128, a microswitch is activated which causes the solenoid 150 to raise the pull arm 154 and the collection gate 158 so that the rods 160, 162 are raised to release the identified hanger 49 so that it may slide along the inclined slide rail 122 to an attachment member 16 at the collection station 128.

The computer 214 corresponds the identified hanger 49 with the attachment member 16 on which it is carried. When the hanger approaches an appropriate sorting station 18, the computer 214 actuates the pick-off rail 218 of the sorting station 18 so that the engaging probe 220 is lowered into the path of the oncoming hanger 49. As the hanger 49 contacts the engaging probe 220 of the pick-off rail 218, the hooked portion 49A of the hanger 49 is caused to slide off the rearward end of the attachment member 16 and onto the pick-off rail 218. Because the pick-off rail 218 is sloped downward, the hanger 49 slides downward along the pick-off rail 218 to the receiving station 21 where the hanger rests against the stop plate 222. The guide rail 226 prevents the hanger 49 from twisting along the pick-off rail 218 and maintains the hanger 49 in a substantially transverse position relative to the pick-off rail 218.

As hangers accumulate at the receiving station 21 the computer 214 causes the actuator 232 to move the stop arm 230 to the engaged position. This prevents further hangers 49 removed from the conveyor 10 by the pick-off rail 218 from reaching the receiving station 21. The hangers stored at the receiving station 21 can then be easily tied together and removed. The actuator 232 then moves the stop arm 230 to the disengaged position so that the remaining hangers 49 are allowed to pass to the receiving station 21 where the process can be repeated.

If necessary, the feeder 30 of FIGS. 2–6 can be easily adjusted so that the tubular support member 48 is inclined in the opposite direction for feeding articles from an opposite direction. This is accomplished by removing the bolt 34 from slot 38 and rebolting the back plate 36 to the vertical arm 32 so that back plate 36 is inclined in the opposite direction with the bolt 34 extending through the slot 40. The second stop member 92 is then moved to the raised position by means of set screw 94 and the additional stop member 96 is lowered by means of the set screw 98. Next, the first stop member 76 is removed from the bore hole 84 by loosening set screw 80 and the bolts 50 which hold the support platform 44 and tubular support member 48 in place on the lower support plate 42. The tubular support member 48 and support platform 44 are then rebolted to the lower support plate 42 so that the rearward end of the support member 48 is located adjacent to the raised second stop member 92. The first stop member 76 is then reinserted into the borehole 84 with the contact face 90 facing rearward along the tubular support member 48. The separating member 110 is then rotated 180 degrees so that the wedge-shaped tip 112 is properly oriented.

Figures 12, 13:
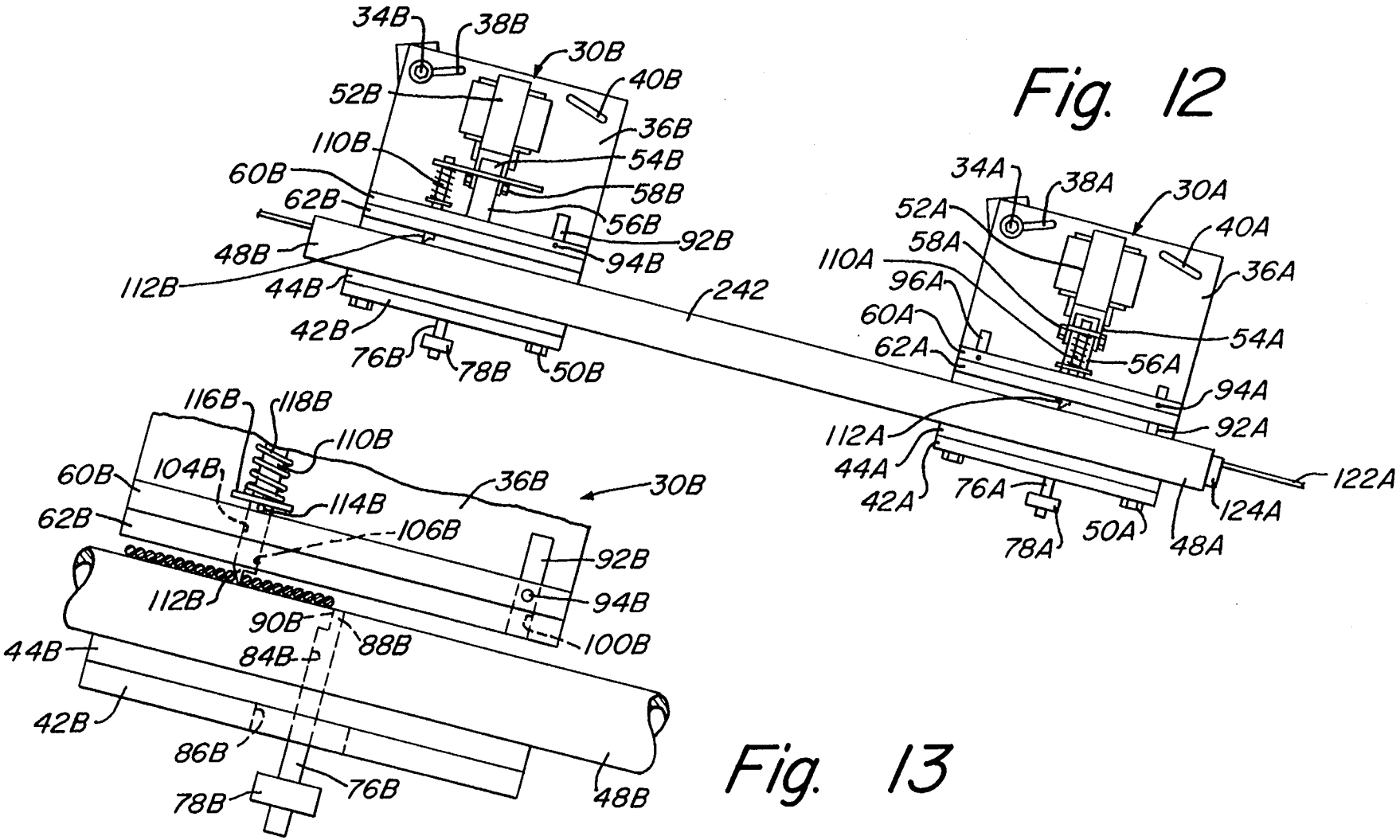
FIG. 12 is a side view of another embodiment of the invention having two feeders mounted in series.
FIG. 13 is an enlarged view of the rearward feeder of FIG. 12 and showing the separating member and first stop member offset.

In another embodiment as shown in FIGS. 12 and 13, two feeders 30A, 30B are joined together by means of an intermediate, tubular extension 242. The feeder 30A is identical to the feeder 30 shown in FIGS. 2–6. The rearward feeder 30B is also similar, however, the separating member 110B is offset along the tubular member 48B a greater degree from the first stop member 76B. This allows the separating member 110B, as shown in FIG. 13, to be interposed between the plurality of hangers so that more than one forward hanger is separated from the plurality of hangers. Depending on the distance the first stop member 76B and the separating member 110B are offset, any number of hangers, for example ten, can be released from the rearward feeder 30B and delivered or carried along the intermediate tubular extension 242 to the forward feeder 30A. In such application, the second stop member 92B of the rearward feeder 30B does not have to be in the lower or engaged position.

Operation of the feeders 30A, 30B are substantially the same with the rearward feeder 30B feeding a desired number of hangers to the forward feeder 30A. This allows the hangers to be fed more smoothly and helps prevent the plurality of hangers supported on the forward feeder 30A from bunching up or overlapping on the tubular support member 48A.

This invention is an improvement over the prior art methods of feeding articles supported on hangers to a sorting conveyor. The invention provides a means of automatically feeding a plurality of unordered hangers smoothly and effectively to a sorting conveyor system, wherein, the hangers are fed one at a time at regular intervals in a quick and efficient manner. Because the hangers are released in stages, garments are effectively separated from each other, overcoming the attractive forces due to static electricity between the garments before being fed to the sorting conveyor.

The reader and transducer allow the garments to be identified more quickly than prior art methods. The feeding system does not require an operator to separately input information through the use of a bar code or manually input the information into the computer. The information is automatically received as the garment is fed to the sorting conveyor.

The collection system allows garments to be collected and removed from the sorting conveyor in a smooth efficient manner. The guide rail prevents the hangers from twisting along the pick-off rail. The stop arm allows a number of hangers to be tied together and removed from the receiving station as garments continue to be sorted from the sorting conveyor. This speeds up the sorting process. There is no need to stop the operation of the sorting conveyor in order to remove garments.

While the invention has been shown in only one of its forms, it should be apparent to those skilled in the art that it is not so limited, but is susceptible to various changes without departing from the scope of the invention.

I claim:

1. A feeding system for feeding individual articles from a plurality of articles supported on a plurality of unordered hangers to a sorting conveyor, the sorting conveyor having a plurality of attachment members spaced along the length of the conveyor for conveying the individual articles to various sorting stations, the conveyor and attachment members being driven along a conveyor path to a collection station, the feeding system comprising in combination:

an elevated support member having a forward end and a rearward end, the support member supporting the plurality of unordered hangers and being inclined so that the plurality of hangers is caused to move downward along the support member to the collection station from the rearward end to the forward end;

a first stop member mounted adjacent to the support member, the first stop member being movable between an engaged position and a disengaged position;

means for moving the first stop member between the engaged position and the disengaged position, the first stop member engaging a forward hanger of the plurality of hangers when in the engaged position so that the plurality of hangers is prevented from downward movement along the support member;

a separating member mounted adjacent to the support member, the separating member being movable between a withdrawn position and an interposed position; and means for moving the separating member between the withdrawn position and the interposed position, the separating member engaging the plurality of hangers when in the interposed position so that the forward hanger is separated from the plurality of hangers and the separating member is interposed between the forward hanger and the plurality of hangers thus preventing the plurality of hangers from downward movement along the support member when the first stop member is moved to the disengaged position, the first stop member disengaging the forward hanger when in the disengaged position to allow the forward hanger to move downward along the support member.

2. The feeding system of claim 1, further comprising:

a second stop member mounted adjacent to the support member, the second stop member being movable between a load and unload position; and means for moving the second stop member between the load and unload positions, the second stop member engaging the forward hanger when in the load position after the forward hanger is disengaged from the first stop member so that the forward hanger is prevented from downward movement along the support member.

3. The feeding system of claim 2, further comprising:

a collection stop member mounted adjacent to the support member between the second stop member and the forward end, the collection stop member being movable between a retaining position and a feed position; and means for moving the collection stop member between the retaining position and the feed position, the collection stop member engaging the forward hanger when in the retaining position to prevent the downward movement of the forward hanger along the support member to the collection station which is located at the forward end of the support member when the second stop member disengages the forward hanger, the collection stop member disengaging the forward hanger when moved to the feed position so that the forward hanger moves downward along the support member to one of the attachment members at the collection station.

4. The feeding system of claim 3, further comprising:

a reader which reads an identifier provided with the forward hanger when the collection stop member is in the retaining position; and computer means which receives an identifying signal from the reader and calculates the position of each attachment member as the conveyor is driven along the conveyor path, the computer actuating the collection stop member when said one of the attachment members approaches the collection station so that the collection stop member is moved to the feed position so that the forward hanger moves downward along the support member to the collection station to said one of the attachment members.

5. The feeding system of claim 4, wherein:

the reader is movable between a retracted position and a reading position, the reader being located in sufficient proximity to the forward hanger to read the identifier when the forward hanger is engaged by the collection stop member and the reader is in the reading position; and further comprising:

means for moving the reader between the retracted and reading positions.

6. The feeding system of claim 4, wherein:

the reader includes an antennae and the identifier includes a transponder.

7. The feeding system of claim 1, wherein:

the separating member and first stop member move in conjunction with each other, with the separating member moving to the interposed position as the first stop member moves to the disengaged position.

8. The feeding system of claim 1, wherein:

the separating member has a wedge-shaped end which is inserted into the plurality of hangers when the separating member is moved to the interposed position.

9. A feeding system for feeding individual articles from a plurality of articles which are supported on a plurality of unordered hangers to a sorting conveyor, the sorting conveyor having a plurality of attachment members spaced along the length of the conveyor for conveying the individual articles to various sorting stations, the conveyor and attachment members being driven along a conveyor path to a collection station, the feeding system comprising in combination:

an elevated support member having a forward end and a rearward end which supports the plurality of unordered hangers and is inclined so that the plurality of hangers is caused to move downward along the support member to a collection station from the rearward end to the forward end;

a base member positioned adjacent to the support member, the base member being movable between a first position and a second position;

means for moving the base member between the first and second positions;

a first stop member which is mounted to the base member, the first stop member engaging a forward hanger of the plurality of hangers supported on the support member when the base member is in the first position so that the plurality of hangers is prevented from downward movement along the support member; and a separating member mounted to the base member, the separating member engaging the plurality of hangers when the base member is moved to the second position, so that the forward hanger is separated from the plurality of hangers and the separating member is interposed between the forward hanger and the plurality of hangers, thus preventing the plurality of hangers from downward movement along the support member when the base member is moved to the second position, the first stop member being disengaged from the forward hanger so that the forward hanger moves downward along the support member when the base member is moved to the second position.

10. The feeding system of claim 9, further comprising:

a second stop member mounted to the base member, the second stop member engaging the forward hanger when the base member is moved to the second position after the forward hanger is disengaged from the first stop member so that the forward hanger is prevented from downward movement along the support member, the second stop member being disengaged from the forward hanger to allow the downward movement of the forward hanger along the support member to the collection station when the base member is moved to the first position.

11. The feeding system of claim 10, further comprising:

a collection stop member mounted adjacent to the support member between the second stop member and the collection station, the collection stop member being movable between a retaining position and a feed position; and means for moving the collection stop member between the retaining position and the feed position, the collection stop member engaging the forward hanger when in the retaining position to prevent the downward movement of the forward hanger along the support member to the collection station when the second stop member disengages the forward hanger, the collection stop member disengaging the forward hanger when moved to the feed position so that the forward hanger moves downward along the support member to one of the attachment members at the collection station.

12. The feeding system of claim 10, further comprising:

a reader which reads an identifier provided with the forward hanger when the collection stop member is in the retaining position; and computer means which receives an identifying signal from the reader and calculates the position of each attachment member as the sorting conveyor is driven along the conveyor path, the computer actuating the collection stop member when said one of the attachment members approaches the collection station so that the collection stop member is moved to the feed position so that the forward hanger moves downward along the support member to the collection station to said one of the attachment members.

13. The feeding system of claim 12, wherein:

the reader includes an antenna and the identifier includes a transponder.

14. The feeding system of claim 12, wherein:

the reader is movable along a rail between a retracted position and a reading position; and means for moving the reader between the retracted position and the reading position, the reader being located in sufficient proximity to the forward hanger to read the identifier when the forward hanger is engaged by the collection stop member and the reader is in the reading position.

15. A feeding system for feeding individual articles from a plurality of articles which are supported on a plurality of unordered hangers to a sorting conveyor, the sorting conveyor having a continuous flexible linkage with a plurality of attachment members spaced along the length of the flexible linkage for conveying the individual articles to various sorting stations, the flexible linkage and attachment members being driven along a conveyor path to a collection station, the feeding system comprising in combination:

a raised support member having a forward end and a rearward end which supports the plurality of unordered hangers and is inclined so that the plurality of hangers is caused to move downward along the support member from the rearward end to the forward end;

an inclined slide rail which extends between the forward end of the support member and the collection station, the slide rail and support member defining a feed path;

a base member positioned adjacent to the support member, the base member being movable between a first position and a second position;

means for moving the base member between the first and second positions;

a first stop member which is mounted to the base member, the first stop member engaging a forward hanger of the plurality of hangers when the base member is in the first position so that the plurality of hangers is prevented from downward movement along the support member;

a separating member mounted to the base member, the separating member engaging the plurality of hangers when the base member is moved to the second position so that the forward hanger is separated from the plurality of hangers and the separating member is interposed between the forward hanger and the plurality of hangers thus preventing the plurality of hangers from downward movement along the support member when the base member is moved to the second position, the first stop member being disengaged from the forward hanger so that the forward hanger moves downward along the support member when the base member is moved to the second position;

a second stop member mounted to the base member, the second stop member engaging the forward hanger when the base member is moved to the second position after the forward hanger is disengaged from the first stop member so that the forward hanger is prevented from downward movement along the feed path, the second stop member being disengaged from the forward hanger to allow the downward movement of the forward hanger along the feed path to the collection station when the base member is moved to the first position;

a collection stop member located between the second stop member and the collection station, the collection stop member being movable between a retaining position and a feed position, the collection stop member engaging the forward hanger when in the retaining position to prevent the downward movement of the forward hanger along the slide rail to the collection station when the second stop member disengages the forward hanger, the collection stop member disengaging the forward hanger when moved to the feed position so that the forward hanger moves downward along the slide rail to one of the attachment members at the collection station;

a reader which reads an identifier provided with the forward hanger when the collection stop member is in the retaining position, the reader being movable along a rail between a retracted position and a reading position;

means for moving the reader between the retracted position and the reading position, the reader being located in sufficient proximity to the forward hanger to read the identifier when the forward hanger is engaged by the collection stop member and the reader is in the reading position; and computer means which receives an identifying signal from the reader and calculates the position of each attachment member as the flexible linkage of the sorting conveyor is driven along the conveyor path, the computer actuating the collection stop member when said one of the attachment members approaches the collection station so that the collection stop member is moved to the feed position so that the forward hanger moves downward along the slide rail to the collection station to said one of the attachment members.

16. An apparatus for identifying individual articles from a plurality of articles which are fed to a sorting conveyor from a feeding system, the sorting conveyor having a plurality of attachment members spaced along the length of the conveyor for conveying the articles to various sorting stations, the conveyor and attachment members being driven along a conveyor path to a collection station, the apparatus comprising in combination:

a collection stop member which is located adjacent to a feed path of the feeding system, the feed path extending to the collection station of the sorting conveyor, the collection stop member being movable between a retaining position and a feed position, the collection stop member engaging a forward article when in the retaining position to prevent the forward article from being fed to the conveyor;

a reader which reads an identifier provided with the forward article, the reader being movable between a retracted position and a reading position;

means for moving the reader between the retracted and reading positions, the reader being located in sufficient proximity to the forward article to receive the identifying signal when the forward article is engaged by the collection stop member and the reader is in the reading position; and computer means which receives an identifying signal from the reader and calculates the position of each attachment member as the sorting conveyor is driven along the conveyor path, the computer actuating the collection stop member when one of the attachment members approaches the collection station so that the collection stop member is moved to the feed position so that the forward article is fed to the collection station to said one of the attachment members.

17. The apparatus of claim 16, wherein:

the reader includes an antenna and the identifier includes a transponder.

18. The apparatus of claim 16, wherein:

the reader is moved along a rail between the retracted position and the reading position; and wherein the means for moving the reader between the retracted and reading positions includes a piston and cylinder.

19. A method of feeding individual articles from a plurality of articles which are supported on a plurality of unordered hangers to a sorting conveyor, the sorting conveyor having a plurality of attachment members spaced along the length of the conveyor for conveying the individual articles to various sorting stations, the conveyor and attachment members being driven along a conveyor path to a collection station, the method comprising the steps of:

supporting the plurality of unordered hangers on an elevated support member so that the plurality of hangers is caused to move downward along the support member to the collection station from a rearward end to a forward end;

engaging a forward hanger of the plurality of hangers with a first stop member in an engaged position so that the plurality of hangers is prevented from downward movement along the support member; then separating the forward hanger from the plurality of hangers by engaging the plurality of hangers with a separating member so that the separating member is interposed between the forward hanger and the plurality of hangers; and then releasing the forward hanger by moving the first stop member from the engaged position to a disengaged position so that the forward hanger moves downward along the support member to the collection station while preventing downward movement of the plurality of hangers along the support member with the separating member when the first stop member is moved to the disengaged position; and then repeating the above steps until all of the hangers are fed to the collection station.

20. The method of claim 19, further comprising the steps of:

engaging the forward hanger with a second stop member after the forward hanger is released from the first stop member so that the forward hanger is prevented from downward movement along the support member; and then feeding the forward hanger to the collection station by moving the second stop member to an unload position so that the forward hanger moves downward along the feed path to a collection station.

21. The method of claim 20, wherein the step of feeding the forward hanger to the collection station includes:

retaining the forward hanger with a collection stop member which is located between the second stop member and the collection station, the collection stop member being movable between a retaining position and a feed position, the collection stop member engaging the forward hanger when in the retaining position to prevent the downward movement of the forward hanger along the support member to the collection station when the second stop member disengages the forward hanger, the collection stop member disengaging the forward hanger when moved to the feed position so that the forward hanger moves downward along the support member to one of the attachment members at the collection station.

22. The feeding system of claim 20, wherein the step of feeding the forward hanger to the collection station includes:

retaining the forward hanger with a collection stop member which is located between the second stop member and the collection station, the collection stop member being movable between a retaining position and a feed position, the collection stop member engaging the forward hanger when in the retaining position to prevent the downward movement of the forward hanger along the support member to the collection station when the second stop member disengages the forward hanger, the collection stop member disengaging the forward hanger when moved to the feed position so that the forward hanger moves downward along the support member to one of the attachment members at the collection station; then reading an identifying signal from the forward hanger with a reader when the collection stop member is in the retaining position, the identifying signal being produced by an identifier which is provided with each of the hangers, the reader being movable between a retracted position and a reading position, the reader being located in sufficient proximity to the forward hanger to receive the identifying signal when the forward hanger is engaged by the collection stop member and the reader is in the reading position; and transmitting the identifying signal to a computer which calculates the position of each attachment member as the flexible linkage of the sorting conveyor is driven along the conveyor path, the computer actuating the collection stop member when said one of the attachment members approaches the collection station so that the collection stop member is moved to the feed position so that the forward hanger moves downward along the support member to the collection station to said one of the attachment members.

23. A feeding system for feeding individual articles from a plurality of articles supported on a plurality of unordered hangers to a sorting conveyor, the sorting conveyor having a plurality of attachment members spaced along the length of the conveyor for conveying the individual articles to various sorting stations, the conveyor and attachment members being driven along a conveyor path to a collection station, the feeding system comprising in combination:

an elevated support member having a forward end and a rearward end, the support member supporting the plurality of unordered hangers and being inclined so that the plurality of hangers is caused to move downward along the support member to the collection station from the rearward end to the forward end;

a rearward feeder mounted adjacent to the support member;

a forward feeder mounted adjacent to the support member, the forward feeder being located forward of the rearward feeder along the support member;

a first stop member mounted to each of the forward and rearward feeders, the first stop member being movable between an engaged position and a disengaged position;

means for moving the first stop member between the engaged position and the disengaged position, the first stop member engaging a forward hanger of the plurality of hangers when in the engaged position so that the plurality of hangers is prevented from downward movement along the support member;

a separating member mounted to each of the forward and rearward feeders, the separating member being movable between a withdrawn position and an interposed position;

means for moving the separating member between the withdrawn position and the interposed position, the separating member engaging the plurality of hangers when in the interposed position so that at least one hanger including the forward hanger is separated from the plurality of hangers and the separating member is interposed between said at least one hanger and the plurality of hangers thus preventing the plurality of hangers from downward movement along the support member when the first stop member is moved to the disengaged position, the first stop member disengaging the forward hanger when in the disengaged position to allow said at least one hanger to move downward along the support member.

24. A collecting system for collecting articles supported on hangers from a sorting conveyor, the sorting conveyor conveying the hangers along a conveyor path, each of the hangers having a hook portion, the collection system comprising in combination:

a receiving station:

a pick-off rail extending between the conveyor and the receiving station, the pick-off rail having an engaging probe for engaging the hook portion of the hangers from the sorting conveyor so that hangers engaged by the engaging probe are directed away from the conveyor path and move along the pick-off rail to the receiving station;

a guide rail mounted adjacent to the pick-off rail for contacting the hangers moving along the pick-off rail so that the hook portion of each hanger is substantially transverse to the pick-off rail as each hanger moves along the pick-off rail to the receiving station;

a stop arm mounted adjacent to the pick-off rail which is moveable between an engaged and disengaged position, the stop arm engaging the hangers moving along the pick-off rail when in the engaged position so that the hangers are prevented from moving to the receiving station; and actuating means for moving the stop arm between the engaged and disengaged positions.

* * * * *